United States Patent [19]

Enomoto et al.

[11] Patent Number: 4,476,836

[45] Date of Patent: Oct. 16, 1984

[54] FUEL-INJECTING APPARATUS

[75] Inventors: Nizo Enomoto, Chita; Fumiaki Murayama, Anjo, both of Japan

[73] Assignee: Nippondenso Co., Ltd., Kariya, Japan

[21] Appl. No.: 455,827

[22] Filed: Jan. 5, 1983

[30] Foreign Application Priority Data

Jan. 11, 1982 [JP] Japan ..... 57-2069

[51] Int. Cl.[3] ..... F02M 59/20

[52] U.S. Cl. ..... 123/502; 123/501; 123/196 R; 123/196 CP

[58] Field of Search ..... 123/501, 502, 196 R, 123/196 CP

[56] References Cited

U.S. PATENT DOCUMENTS

| | | | |
|---|---|---|---|
| 3,401,572 | 9/1968 | Bailey | 123/501 |
| 4,132,202 | 1/1979 | Nakayama et al. | 123/501 |
| 4,198,948 | 4/1980 | Conrad et al. | 123/196 R |
| 4,332,227 | 6/1982 | Bauer et al. | 123/501 |

FOREIGN PATENT DOCUMENTS

| | | | |
|---|---|---|---|
| 1210245 | 2/1966 | Fed. Rep. of Germany | 123/501 |
| 54-21487 | 7/1979 | Japan . | |
| 56-99026 | 8/1981 | Japan . | |
| 60405 | 4/1938 | Norway | 123/501 |
| 489817 | 8/1938 | United Kingdom | 123/502 |
| 502127 | 4/1976 | U.S.S.R. | 123/502 |

*Primary Examiner*—Magdalen Y. C. Moy

*Attorney, Agent, or Firm*—Cushman, Darby & Cushman

[57] ABSTRACT

A fuel-injecting apparatus supplies fuel to an internal combustion engine in a timing and at a rate adapted for its operation. The internal combustion engine includes a lubricant trap provided at the bottom of the internal combustion engine to collect lubricant for lubricating the internal combustion engine and a fuel pump for supplying the lubricant held in the lubricant trap to a fuel-injection device. In the fuel-injecting apparatus the intermediate part of a passage through which lubricant is delivered to a fuel-injection timing control device is branched off, and the branched division of the lubricant passage is made to communicate with the lubricated section of the fuel pump.

4 Claims, 5 Drawing Figures

FUEL-INJECTING APPARATUS

BACKGROUND OF THE INVENTION

This invention relates to a fuel-injecting apparatus used with an internal combustion engine, and more particularly to a fuel-injecting apparatus which is designed to transmit the rotation speed of the shaft of an internal combustion engine to a fuel-injecting pump with the rotation angle of said shaft regulated by advancing or retarding the phase of said angle by a lubricant pressure type device for controlling the fuel-injection timing (hereinafter referred to as fuel-injection timing control device).

The fuel-injecting apparatus of an internal combustion engine is generally so designed as to cause a fuel-injecting pump to be driven by the rotation moment of the shaft of said internal combustion engine. The injection of fuel should be effected in a timing controlled by advancing or retarding the rotation angle of the shaft of the internal combustion engine in accordance with the rotation speed of said shaft. To this end, therefore, a fuel-injection timing control device is provided between the internal combustion engine and the fuel-injecting pump.

A fuel-injecting pump disclosed, for example, in the Japanese Patent Publication No. Sho 54-21,487 may be cited as a typical device, wherein the rotation of a pump shaft supplied with a drive force from the internal combustion region is converted into the reciprocating movement of a plunger by means of a cam and tappet, and the discharge and suction of fuel are effected by the reciprocating movement of the plunger.

A fuel-injection timing control device set forth in the Japanese Utility Model Disclosure No. Sho 56-99,026 (FIG. 3) may be cited as a known type. With this type of fuel-injection timing control device, the pressure of drive lubricant supplied from a lubricant pump is controlled in accordance with the operating condition of an internal combustion engine. The controlled lubricant pressure is made to act on a piston. The advance or retardation of the rotation angle phase of the internal combustion engine shaft is controlled by the movement of the piston resulting from said controlled lubricant pressure. In other words, the above-mentioned fuel-injection timing control device indicated in the Japanese Utility Model Disclosure No. Sho 56-99,026 is the type in which the fuel-injection timing is controlled by external lubricant pressure.

A lubricant pump has to be provided as a source of pressure in order to practically apply the above-mentioned fuel-injection timing control device to an internal combustion engine. In practice, a lubricant-pressurizing pump received in an internal combustion engine is applied, and lubricant is used as drive oil.

With the aforementioned fuel-injecting pump, it is necessary to lubricate that surface of the cam along which the tappet slides. When, however, a passage through which lubricant is supplied as drive oil to the fuel-injection timing control device is constructed separately from a passage through which lubricant is conducted to the lubricated section of a fuel pump, then two oil passage have to be provided, resulting in the drawbacks that an arrangement surrounding the fuel pump and fuel-injection timing control device is complicated, thereby increasing the cost of a fuel-injecting apparatus.

SUMMARY OF THE INVENTION

This invention has been created in view of the above-mentioned circumstances and is intended to provide a fuel-injecting apparatus for use with an internal combustion engine wherein a passage through which lubricant is supplied as drive oil to a fuel-injection timing control device and a passage through which lubricant is conducted to the prescribed lubricated section of a fuel pump are unified into a single system, thereby simplifying the construction of the whole fuel-injecting apparatus, allowing for its easy assembly, and reducing its manufacturing cost.

In other words, a fuel-injecting apparatus embodying this invention is characterized in that the intermediate part of a passage through which lubricant is delivered to a fuel-injection timing control device is branched off, and the branched division of the lubricant passage is made to communicate with the lubricated section of the fuel pump.

DETAILED DESCRIPTION OF THE PREFERRED EMBODIMENTS

Description with now be given with reference to FIGS. 1 to 4 of a fuel-injecting apparatus according to one embodiment of this invention.

Figure 1:
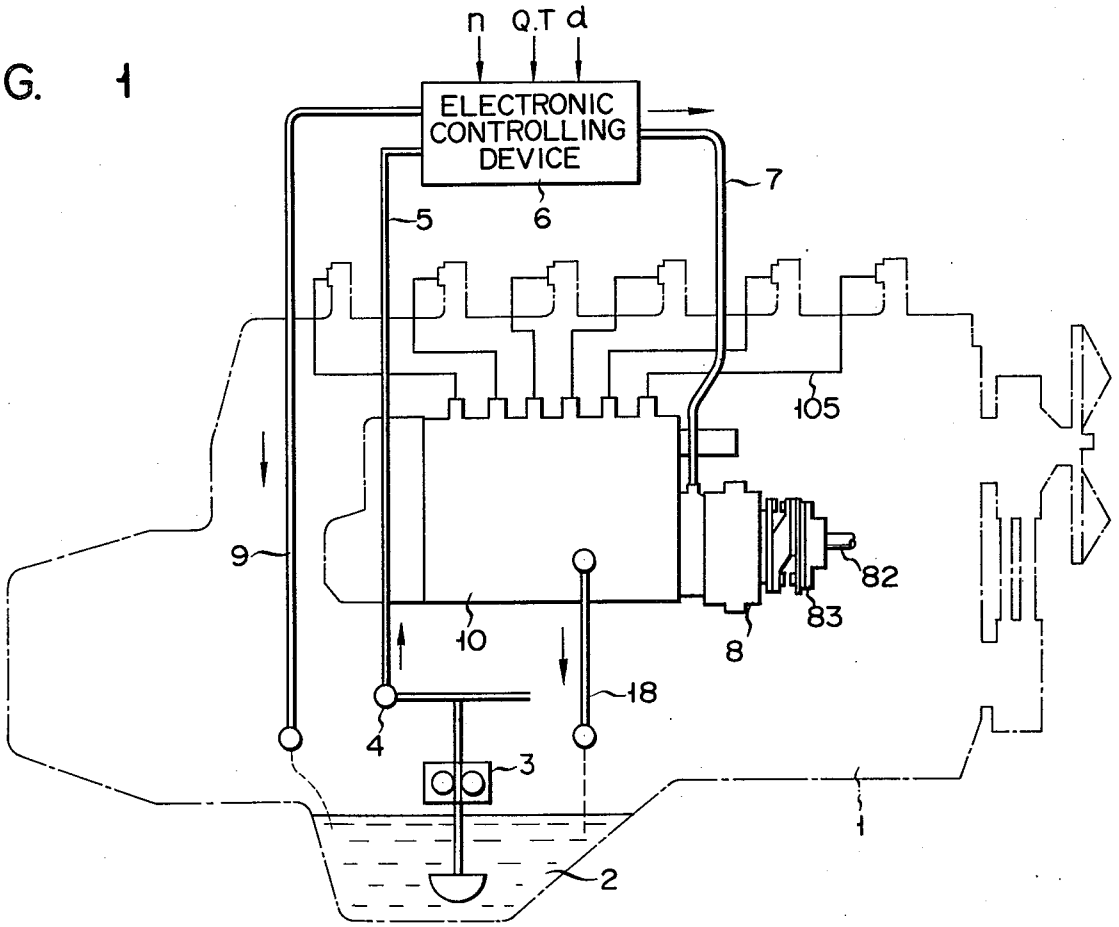
FIG. 1 is a schematic front view of a piping system of a fuel-injecting apparatus according to one embodiment of this invention.

As seen from FIG. 1, an internal combustion engine (a diesel engine in this embodiment) comprises a lubricant pan 2 provided at the bottom to be used as a receptacle. A fuel-pressurizing pump 3 sucks up lubricant held in the lubricant pan 2 through an oil filter (not shown). The sucked lubricant is sent under pressure to an electronic control device 6 from a delivery section 4 through a conduit 5. The electronic controlling device 6 communicates with a fuel-injection timing control device 8 through a conduit 7. The lubricant whose pressure is controlled by the electronic control device 6 to cause the rotation angle phase of the shaft of an internal combustion engine 1 (hereinafter simply referred to as the engine 1) to be advanced or retarded as required is supplied to the fuel-injection timing control device 8 through the conduit 7. Data concerning the number n of the rotations of the shaft of an internal combustion engine, fuel-injection rate Q, atmospheric temperature T and fuel-injection timing signal $\alpha$ are stored in a microcomputer in the electronic control device 6. This electronic control device 6 compares the above items of stored information with previously stored prescribed values and sends a signal denoting the result of said comparison as an electric instruction signal. A fuel pressure-controlling valve (not shown) has its operation regulated by said instruction signal. As a result, the lubricant supplied through the pipe 5 has its pressure controlled by the electronic control device 6 to a proper level for the operating condition of the engine 1. The pressure-controlled lubricant is supplied to the fuel-injection timing control device 8 through the pipe 7. Surplus lubricant which results from the control of lubricant pressure by the electronic control device 6 is carried back to the lubricant pan 2 through a return pipe 9. The fuel-injecting timing control device 8 transmits the drive force of the engine 1 to the fuel pump 10.

Figure 2:
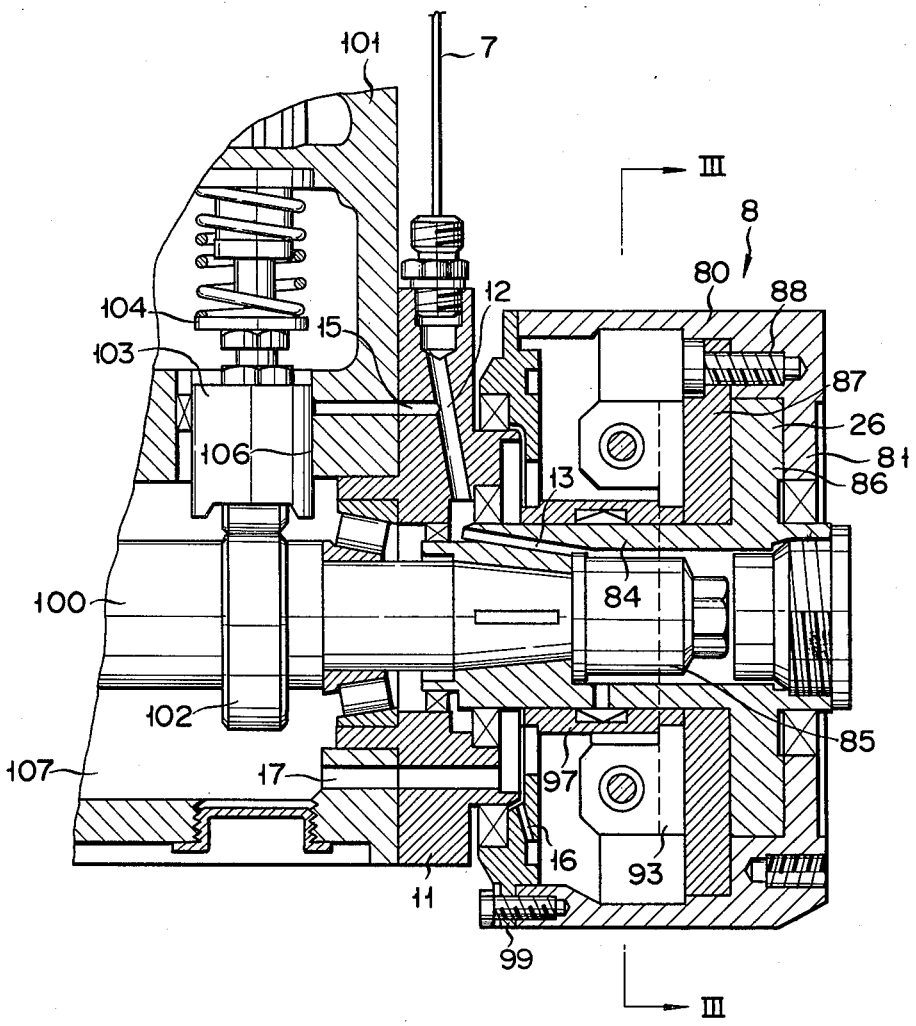
FIG. 2 is a fractional cross-sectional view of a fuel pump and fuel-injection timing control device used with the embodiment of FIG. 1.
Figure 3:
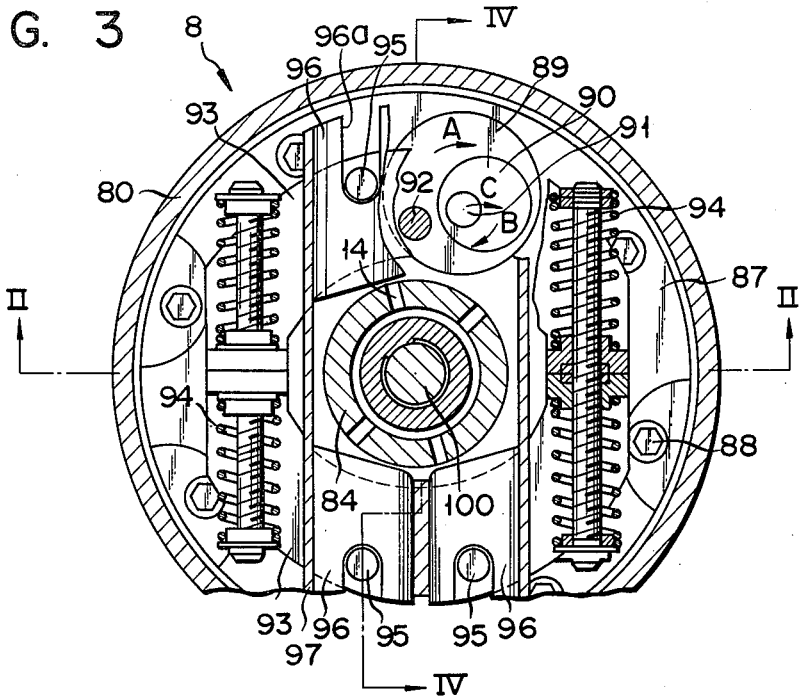
FIG. 3 is a sectional view of line III—III of FIG. 2.
Figure 4:
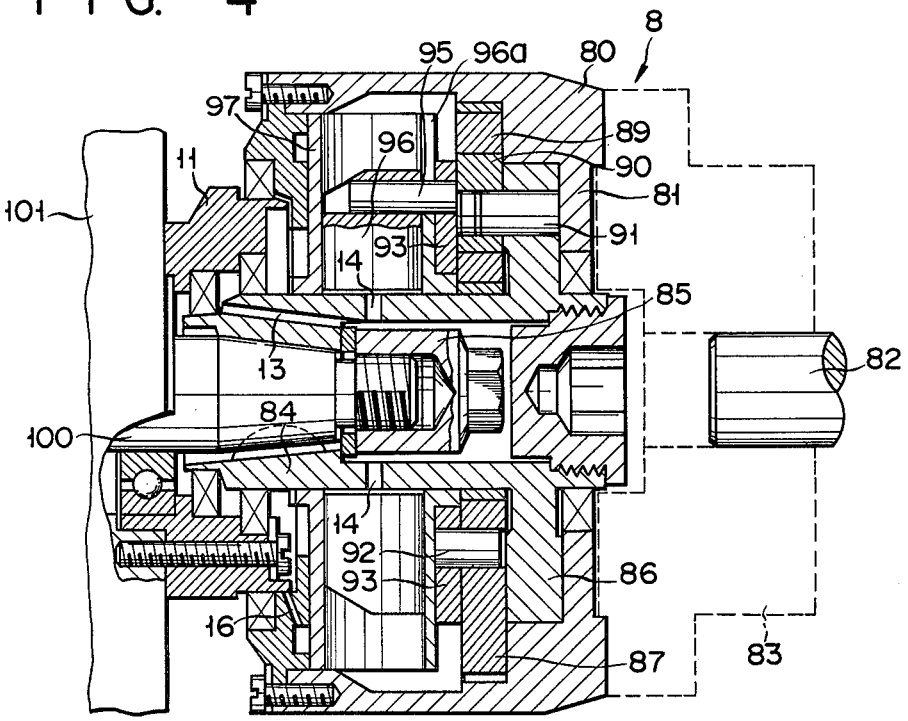
FIG. 4 is a sectional view on line IV—IV of FIG. 3.

As shown in FIGS. 2 to 4, said fuel-injection timing control device 8 comprises a casing 80. A first integrally formed flange 81 is fitted to one side of the casing 80 in an inward extending state. The first flange 81 is connected to a drive shaft 82 (FIGS. 1 and 4) for transmitting the drive force of the engine 1 through a flange nippel 83 (FIG. 1). As a result, the casing 80 is rotated by the drive of the engine 1. A drive sleeve 84 is mounted on the central shaft of the casing 80 in a rotatable state relative to said casing 80. A cam shaft 100 of the fuel pump 10 is connected at one end to the driven sleeve 84 by means of a cap nut 85 in a state rotatable therewith.

An outward extending second flange 86 is integrally formed with the driven sleeve 84 in a state slidable along the inner wall of the first flange 81. A disc-shaped support board 87 is separately mounted on the inner wall of the second flange 86. The support board 87 is fixed to the first flange 81 by means of a bolt 88. As shown in FIG. 3, a pair of major disc-shaped eccentric cams 89 are rotatably mounted on the support board 87 in a state eccentrically positioned from the cam shaft 100. A minor disc-shaped eccentric cam 90 is rotatably mounted on each major disc-shaped eccentric cam 89 in a state eccentrically positioned from the center of said major eccentric cam 89. A one end portion of an eccentric pin 91 is projectively provided on the minor eccentric cam 89 in a state eccentrically positioned from the center of said minor eccentric cam 89. The other end portion of said eccentric pin 91 is rotatably inserted into the second flange 86. A one end portion of an eccentric pin 92 is projectively provided on each major eccentric cam 89 at another eccentric point. Each slide board 93 is fitted to the inner wall of the support board 87 in a radially inward urged state. Each slide board 93 is connected to two pistons 96 by means of the corresponding two connection pins 95. The outer end portion of the connection pin 95 is inserted into a slit **96*a* formed in the lateral wall of the piston 96. The piston 96 is received in the corresponding cylinder 97, and is moved radially outward by the oil pressure acting on said piston 96**.

The aforementioned pipe 7 is connected, as shown in FIG. 2, to a lubricant passage 12 formed in a connection flange 11 for fitting the fuel-injection timing control device 8 to the fuel pump 10. The lubricant passage 12 communicates with the interior space of the sleeve 84 through a conduit 13 provided in said sleeve 84. As shown in FIGS. 3 and 4, a plurality of passages 14 are formed in the sleeve 84 for communication with the interior of the cylinder 97.

When, therefore, the pressurized lubricant whose pressure is controlled through the conduit 7 is carried into the cylinder 97 through the fuel passage 12, conduit 13, the interior space of the sleeve 84 and the plural passages 14, then the piston 96 is pushed radially outward. The movement of the piston 96 causes the slide board 93 to be moved radially outward against the urging force of the spring 94. The rotation of the major eccentric cam 89 in the direction of an indicated arrow A causes the minor eccentric cam 90 to be moved in the direction of an indicated arrow B. As a result, the eccentric pin 91 is rotated in the direction of an indicated arrow C, causing the second driven flange 86 to be moved also in the direction of the indicated arrow C. Since the movement of the second driven flange 86 causes the sleeve 84 to be jointly moved in the direction of the indicated arrow C, the sleeve 84 is moved in the direction of the advanced angle phase relative to the casing 80. Accordingly, the angle phase of the cam shaft 100 is advanced relative to the drive shaft 82 of the engine 1.

As shown in FIG. 2, the cam shaft 100 is inserted into a pump housing 101 of the fuel pump 10. A tappet 103 is vertically reciprocated by means of an eccentric cam 102 integrally formed with the cam shaft 100 or attached thereto by proper fixing means. The tappet 103 is connected to a plunger (not shown) by means of a bolt 104. The reciprocation of the tappet 103 gives rise to the similar movement of the plunger. The reciprocation of the plunger causes the fuel sucked into a pump chamber (not shown) to be injected under pressure into the various cylinders through a plurality of fuel pipes 105 (FIG. 1).

As shown in FIG. 2, a lubricant passage 15 branched off from the lubricant passage 12 extends through the connection flange 11 and pump housing 101. The branched lubricant passage 15 faces a slide plane defined between the tappet 103 and a guide plane 106 formed in the pump housing 101 to guide the reciprocation of said tappet 103. A minute gap provided for the slide plane performs a sort of throttling function, that is, acts as the orifice of the branched lubricant passage 15 to elevate a resistance to the lubricant flow.

The lubricant introduced through the branched lubricant passage 15 lubricates a slide plane defined between the tappet 103 and guide plane 106 and further a slide plane defined between said tappet 103 and cam 102. The lubricant drips into the cam chamber 107 to be collected at the bottom.

Lubricant brought into the cylinder 97 of the fuel-injection timing control device is collected in the outer peripheral section of the casing 80 through a gap defined between the cylinder 97 and piston 96. A drain passage 16 is formed in a board 99 for closing the casing 80. The drain passage 16 communicates with a cam chamber 107 through an escapement path 17 extending through the connection flange 11 and pump housing 101. The cam chamber 107 communicates with the lubricant pan 2 through a return conduit 18 shown in FIG. 1.

With a fuel-injecting apparatus according to one embodiment of this invention which is constructed as described above, the lubricant whose pressure is controlled to a level adapted for the operating condition of the engine 1 is carried into the lubricant passage 12 through the conduit 7. The branched lubricant passage 15 communicates with the intermediate part of the lubricant passage 12, causing the lubricant stream to be branched off into the fuel-injection timing control device 8 and fuel-injection pump 10.

With the fuel-injection timing control device 8, the piston 96 is moved, as previously described, to an extent corresponding to the lubricant pressure. The sleeve 84 has its position changed, in accordance with the magnitude of the lubricant pressure. With the fuel pump 10, a slide plane defined between the tappet 103 and guide plane 106, and also a slide plane defined between said tappet 103 and cam 102 are lubricated.

The lubricant which has finished the lubrication of the fuel pump 10 is collected in the cam chamber 107. The lubricant held in the casing 80 of the fuel-injection timing control device 8 is drained into the cam chamber 107 through the drain passage 16 and escapement path 17. The lubricant in the cam chamber 107 is brought back to the lubricant pan 2 through the return conduit 18.

A fuel-injecting apparatus according to one embodiment of this invention has the advantages that since the lubricant is supplied through the conduit 7 and fed back through the return conduit 18, it is possible to decrease the number of lubricant passages, simplify the construction of the subject fuel-injecting apparatus and facilitate its assembly, thereby reducing the manufacturing cost of said fuel-injecting apparatus.

With the branched lubricant passage 15, a fine gap defined between the tappet 103 and guide plane 106 performs a sort of throttling action, thereby eliminating the possibility that the lubricant whose pressure is controlled to a desired level by the electronic control device 6 escapes to the fuel pump 10, and consequently enabling the prescribed lubricant pressure to be applied to the piston 96 of the fuel-injection timing control device 8.

Figure 5:
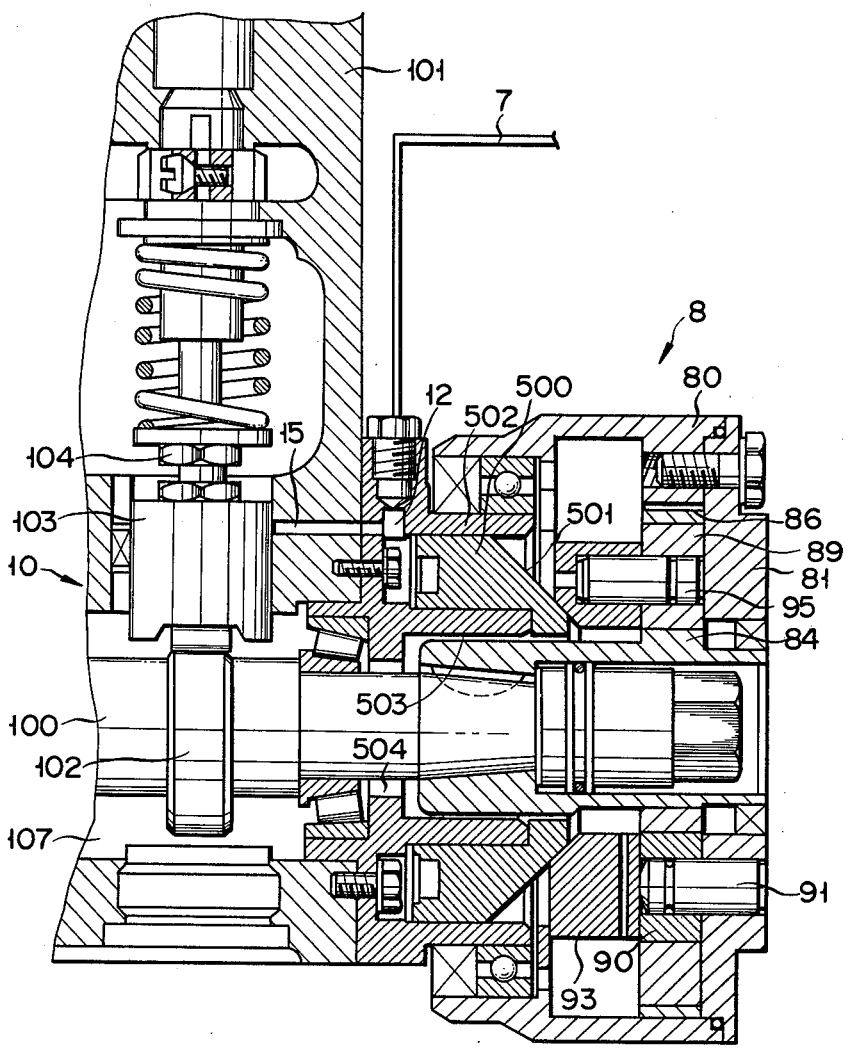
FIG. 5 is a sectional view of that portion of a fuel-injecting apparatus according to another embodiment of the invention which corresponds to the condition of FIG. 2.

The foregoing description of the one embodiment of this invention refers to the case where the fuel-injection timing control device 8 is the type in which the piston 96 is moved radially outward. It will be noted, however, that the invention is not limited to the one embodiment, but another embodiment shown in FIG. 5 is also applicable. The fuel-injecting apparatus of FIG. 5 according to another embodiment of the invention is the type in which a piston 500 is moved along the axis of its own. The piston 500 is moved radially outward along the slide board 93 by means of an inclined plane 501 of said piston 500. A cylinder 502 for receiving the piston 500 is integrally formed with the connection flange 11. A narrow gap 503 is defined between the cylinder 502 and sleeve 84. The lubricant which is let to pass between the piston 500 and cylinder 502 is conducted into the above-mentioned narrow gap 503. An escapement path 504 allowing for communication between said narrow gap 503 and cam chamber 107 is formed between the connection flange 11 and cam shaft 100.

With the fuel-injecting apparatus of FIG. 5 according to another embodiment of this invention, the lubricant is supplied through one passage and brought back through one return conduit. In other words, a fuel-injecting apparatus embodying the invention can be practiced, provided the fuel-injection timing control device 8 is the type in which the rotation force of the shaft of the internal combustion engine is transmitted to a fuel pump with the phase of said rotation angle advanced or retarded by a device for controlling fuel-injecting timing by lubricant pressure. The throttling section of the branched lubricant passage 15 may be formed at a different spot from that which is defined between the tappet 103 and guide plane 106.

What we claim is:

1. Fuel-injecting apparatus for supplying fuel to an internal combustion engine at a timing and at a rate adapted for its operation, said internal combustion engine including cylinders, a shaft and a first lubricant trap provided at the bottom of said internal combustion engine to collect lubricant for lubricating said internal combustion engine and means for supplying the lubricant held in said first lubricant trap to a fuel-injection apparatus, said fuel-injecting comprising:

a fuel pump adapted to be driven by the internal combustion engine to inject fuel into the cylinders of said engine at a prescribed rate and being provided with a section to be lubricated by said lubricant;

a fuel-injection timing control device provided between said lubricant supply means and fuel pump to receive lubricant from said lubricant supply means for controlling the timing in which the fuel pump injects fuel in accordance with the magnitude of the lubricant pressure;

a first lubricant passage extending through said lubricant supply means and fuel-injection timing control device for supplying lubricant from said lubricant supply means to the fuel-injection timing control device;

a second lubricant passage, one end portion of which communicates with the first lubricant passage, and the other end of which faces the lubricated section of the fuel pump, for conducting lubricant from said lubricant supply means to the lubricated section of the fuel pump;

a throttling section formed in the second lubricant passage to prevent a drop in the pressure of lubricant delivered from said lubricant supply means even when said lubricant is supplied to the lubricated section of the fuel pump, wherein said fuel-injection timing control device controls the timing in which the fuel pump injects fuel by changing the rotation angle phase of the shaft of the internal combustion engine and that of the fuel pump in accordance with the magnitude of the pressure of lubricant delivered from the lubricant supply means, wherein said fuel pump includes:

a pump shaft rotated by the internal combustion engine, at least one eccentric cam mounted on said pump shaft, a tappet pressed against said eccentric cam to be reciprocated by the rotation of said fuel pump shaft, a pump housing provided with a guide plane allowing for the reciprocation of said tappet, wherein said eccentric cam and tappet are pressed against each other at the lubricated section of the fuel pump; and, wherein said second lubricant passage extends through the pump housing, and the other end of said lubricant passage is open to the guide plane of said pump housing.

2. The fuel-injecting apparatus according to claim 1, wherein the tappet and the guide plane of said pump housing are spaced apart from each other with an extremely minute clearance, thereby constituting the throttle section of said second lubricant passage.

3. The fuel-injecting apparatus according to claim 2, wherein the fuel-injection timing control device is provided with a second lubricant trap for collecting the lubricant carried to said controlling device; the fuel pump is provided with a third lubricant trap for collecting the lubricant brought to said pump; and the second and third lubricant traps communicate with each other through a first return passage.

4. The fuel-injecting apparatus according to claim 3, which further comprises a second return passage for causing said third lubricant trap to communicate with said first lubricant trap, and wherein the lubricant overflowing said third lubricant trap is returned to said first lubricant trap through said return passage.

* * * * *